US008062088B2

(12) United States Patent
Perry

(10) Patent No.: US 8,062,088 B2
(45) Date of Patent: Nov. 22, 2011

(54) MODULAR CONSTRUCTION SYSTEM AND METHOD WITH ASYMMETRIC RIGID BALANCED FIGURINES HAVING BALANCE-ENHANCING MAGNETS

(75) Inventor: John Perry, Oxnard, CA (US)

(73) Assignee: Quill Inc., Oxnard, CA (US)

( * ) Notice: Subject to any disclaimer, the term of this patent is extended or adjusted under 35 U.S.C. 154(b) by 449 days.

(21) Appl. No.: 12/152,706

(22) Filed: May 15, 2008

(65) Prior Publication Data

US 2009/0203290 A1 Aug. 13, 2009

Related U.S. Application Data

(60) Provisional application No. 61/065,580, filed on Feb. 11, 2008.

(51) Int. Cl.
*A63H 33/26* (2006.01)

(52) U.S. Cl. ..... 446/139; 446/137; 446/92; 446/99; 446/101; 446/118

(58) Field of Classification Search ..... 446/139, 446/101, 137, 92, 99, 118, 119; D21/590, D21/594, 576; 273/288, 456
See application file for complete search history.

(56) References Cited

U.S. PATENT DOCUMENTS

| | | | | | |
|---|---|---|---|---|---|
| 1,481,129 | A | * | 1/1924 | French | 446/99 |
| 2,377,616 | A | | 2/1945 | Davis | |
| 2,736,132 | A | | 2/1954 | Murray | |
| 2,767,517 | A | * | 10/1956 | Hooper | 446/139 |
| 3,246,422 | A | | 4/1966 | Teagarden | |
| 3,392,480 | A | * | 7/1968 | Stubbmann | 446/121 |
| 3,407,530 | A | * | 10/1968 | Grant et al. | 446/92 |
| 4,205,482 | A | * | 6/1980 | Christiansen et al. | 446/97 |
| 4,226,045 | A | * | 10/1980 | Lehmann et al. | 446/101 |
| 4,667,956 | A | | 5/1987 | Davis | |
| 4,991,836 | A | | 2/1991 | Joffe | |
| 5,024,611 | A | | 6/1991 | Eckerle et al. | |
| 5,152,711 | A | | 10/1992 | Gross | |
| 5,362,271 | A | | 11/1994 | Butt | |
| 5,886,608 | A | | 3/1999 | Chabay | |
| 6,017,220 | A | | 1/2000 | Snelson | |
| 6,132,284 | A | | 10/2000 | Lin | |
| 6,164,654 | A | | 12/2000 | Tricomi | |
| 6,887,121 | B2 | * | 5/2005 | Whitehead | 446/129 |
| 7,591,471 | B2 | | 9/2009 | Walterscheid | |
| 2003/0129920 | A1 | | 7/2003 | Sze | |
| 2005/0170739 | A1 | | 8/2005 | Zoellner | |
| 2006/0099877 | A1 | | 5/2006 | Anderson | |

* cited by examiner

*Primary Examiner* — Gene Kim
*Assistant Examiner* — Matthew B Stanczak
(74) *Attorney, Agent, or Firm* — Christie, Parker & Hale, LLP

(57) ABSTRACT

A modular construction system involving at least one balancing element having a center of gravity, a vertical axis, and at least one balancing surface for enhancing equilibrium; and at least one permanent magnet disposed at each at least one balancing surface, the system optionally having a base, wherein balancing the at least one balancing element in relation to the base is facilitated, and wherein the base optionally includes a feature, such as a magnetic property, a metal, at least one leveling device.

11 Claims, 3 Drawing Sheets

MODULAR CONSTRUCTION SYSTEM AND METHOD WITH ASYMMETRIC RIGID BALANCED FIGURINES HAVING BALANCE-ENHANCING MAGNETS

CROSS-REFERENCE TO RELATED APPLICATION(S)

This document is a non-provisional patent application which is related to, and claims priority from, U.S. Provisional patent application Ser. No. 61/065,580, also entitled "Modular Construction System and Method with Asymmetric Rigid Balanced Figurines Having Balance-Enhancing Magnets," filed on Feb. 11, 2008, the subject matter of which is hereby incorporated in its entirety by reference.

TECHNICAL FIELD

The present invention technically relates to novelty item, game, toy, interactive art piece, amusement, and educational systems and methods. More particularly, the present invention technically relates to novelty item, game, toy, interactive art piece, amusement, and educational systems and methods for use on a horizontal surface. Even more particularly, the present invention technically relates to modular novelty item, game, toy, interactive art piece, amusement, and educational systems and methods for use on a horizontal surface.

BACKGROUND ART

The currently existing related art involves several tabletop novelty items. One such invention is disclosed in Hooper (U.S. Pat. No. 2,767,517) involves a magnetic toy which simulates a symmetric clown with magnets embedded in its upper and lower surfaces, wherein a ball, a hat, or another clown is supported on the clown via complementary magnets. Hooper's attached objects are coupled only by the pulling force of the magnets, as the bottom of the ball is rounded. The toy is arranged in various positions with other objects via magnetic forces only, but does not actually provide gravitational "balance" but merely provides for the coupling of elements using magnet forces only, does not provide for any stackability of the elements or any features that would enhance stackability, and does not provide any asymmetrical balancing-challenge to the user.

Gross (U.S. Pat. No. 5,152,711) involves a magnetic toy which uses two magnetic structures and a magnetic platform plate to allow the user to create a variety of arrangements using magnetic particles, but does not provide any asymmetrical balancing-challenge to the user. The two magnetic structures are disposed in a manner such that the same magnetic polarity for each structure is adjacent to the platform plate, thereby allowing the magnetic particles to be formed in either bridging configurations or divergent stand-alone configurations.

Eckerle et al. (U.S. Pat. No. 5,024,611) involves a doll support apparatus that includes a ferromagnetic base having an upwardly facing support surface for receiving the bottom surface of a doll foot device, the doll foot device incorporating a magnetic insert which, when supported on such surface, is disposed in close proximity to the ferromagnetic base, thereby maintaining the doll in an erect position, but does not actually provide gravitational "balance" but merely provides for the coupling of elements using magnet forces only, does not provide for any stackability of the elements nor any features that would enhance stackability, and does not provide any asymmetrical balancing-challenge to the user. The foot device may be in the form of a foot representation having a magnetic insert embedded directly therein or may be in the form of a removable shoe having the magnetic insert embedded therein. The foot or the shoe may incorporate a hinge element that incorporates a releasable lock for locking the shoe or foot in selectable positions.

Common problems experienced in the related art are poor balancing and limited usability, because the related art inventions do not enhance static equilibrium by challenging the user to balance the relative moments of inertia among a plurality of figurines and a plurality of auxiliary objects, because the related art inventions do not disclose at least one flattened surface for accommodating embedded magnets and for facilitating stacking of a plurality of figurines in combination with modern high strength magnets. Thus, a long-felt need is seen to exist for a system and a method which better enhances static equilibrium in novelty items, toys, games, interactive art pieces, amusement items, and educational tools.

DISCLOSURE OF THE INVENTION

The present invention addresses the foregoing problems in the related art in a system and corresponding methods for providing an all-in-one novelty item, toy, game, interactive art piece, amusement item, and educational tool. The present invention modular construction system generally involves asymmetric rigid balanced figurines, the balancing of which is enhanced by magnets that are strategically disposed in relation to vertical axes as well as to moment arms of the figurines.

The present invention modular construction system generally comprises: at least one balancing element, having a center of gravity, a vertical axis, and at least one pair of parallel opposing surfaces, e.g., generally flat surfaces or balancing surfaces, for enhancing equilibrium; and a plurality of permanent magnets, at least two permanent magnets of the plurality of permanent magnets being collinearly disposed along the vertical axis for facilitating balancing, and at least one permanent magnet of the plurality of permanent magnets being offset in relation to the vertical axis for providing balanceable moments of inertia, whereby balancing the at least one balancing element is facilitated. The present system further comprises at least one base optionally having a magnetic property, wherein balancing the at least one balancing element in relation to the base is facilitated.

The present invention method of fabricating a modular construction system, generally comprises the step of providing at least one balancing element, having a center of gravity, a vertical axis, and at least one pair of parallel opposing surfaces, e.g., generally flat surfaces or balancing surfaces, for enhancing equilibrium; and providing a plurality of permanent magnets, the plurality of permanent magnets providing step comprising the step of collinearly disposing at least two permanent magnets of the plurality of permanent magnets along the vertical axis for facilitating balancing, and the step of offsetting at least one permanent magnet of the plurality of permanent magnets in relation to the vertical axis for providing balanceable moments of inertia, thereby providing balanceability of the at least one balancing element. The present fabrication method further comprises providing at least one base optionally having a magnetic property for facilitating balancing the at least one balancing element in relation to the base is facilitated.

The present invention method of balancing figurines by way of a modular construction system, generally comprises the steps of providing at least one balancing element, having a center of gravity, a vertical axis, and at least one pair of parallel opposing surfaces, e.g., generally flat surfaces or balancing surfaces, for enhancing equilibrium; and providing a plurality of permanent magnets, the plurality of permanent magnets providing step comprising the step of collinearly disposing at least two permanent magnets of the plurality of permanent magnets along the vertical axis for facilitating balancing, and the step of offsetting at least one permanent magnet of the plurality of permanent magnets in relation to the vertical axis for providing balanceable moments of inertia, thereby providing balanceability of the at least one balancing element. The present fabrication method further comprises providing at least one base optionally having a magnetic property for facilitating balancing the at least one balancing element in relation to the at least one base is facilitated; and manually disposing the at least one balancing element in relation to the at least one base or to any other at least one balancing element.

Advantages of the present invention include, but are not limited to, providing a novelty item, a game, a toy, an interactive art piece, an amusement item, and an educational tool that challenges a user's skills and creativity while also providing endless configuration possibilities. Other features of the present invention are disclosed, or are apparent, in the section entitled "Mode(s) for Carrying-Out the Invention," disclosed, infra.

BRIEF DESCRIPTION OF THE DRAWING

For a better understanding of the present invention, reference is made to the below-referenced description of the accompanying Drawing. Reference numbers refer to the same or equivalent parts of the present invention throughout the several figures of the Drawing.

MODE(S) FOR CARRYING-OUT THE INVENTION

Figure 1:
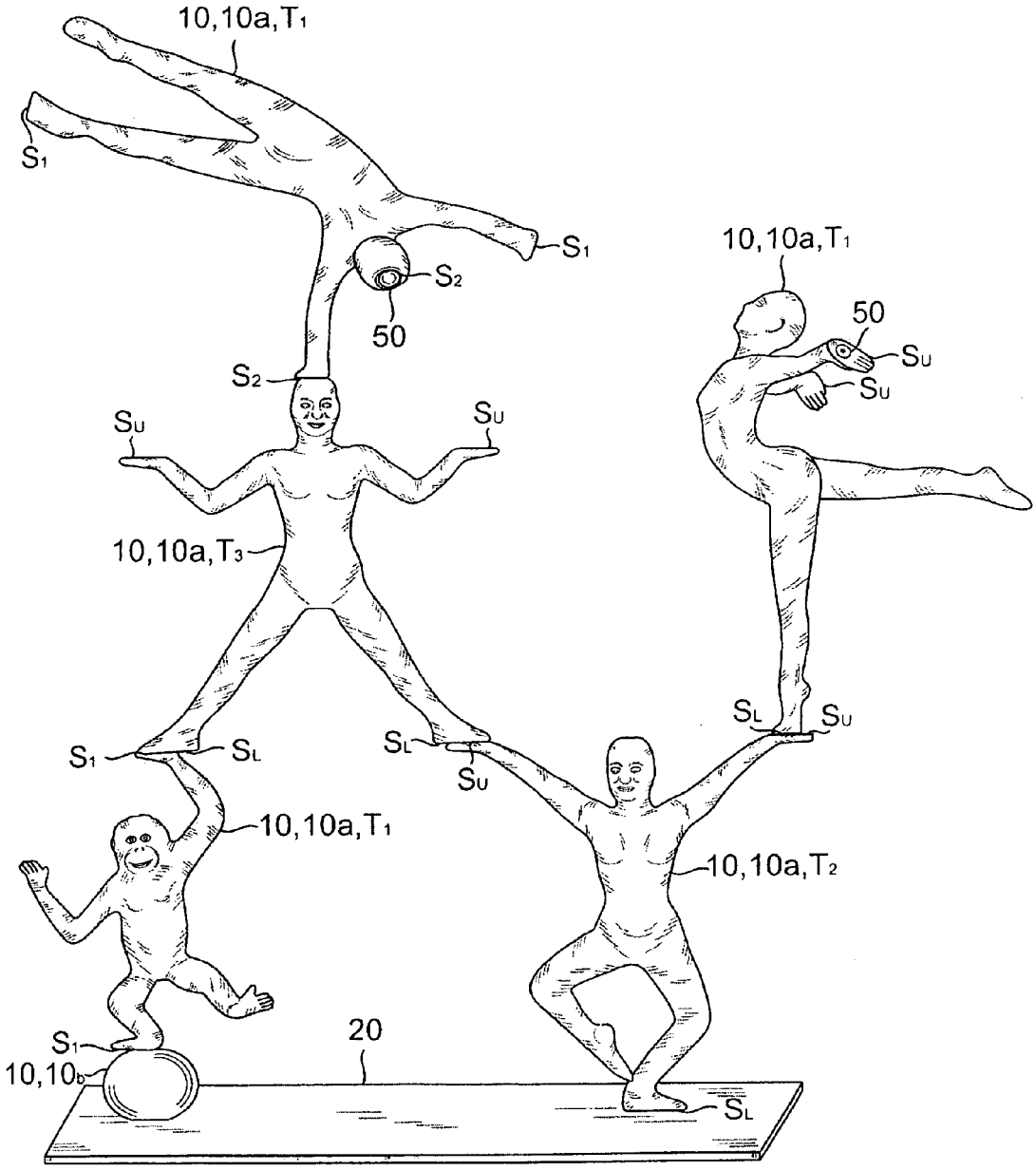
FIG. 1 is a front view of a modular construction system, comprising a plurality of balancing elements with vertically-aligned magnets disposed at corresponding primary balancing surfaces in an assembled state, by example only, in accordance with the present invention.

FIG. 1 is a perspective view of a modular construction system 100 with vertically-aligned magnets 50 in an assembled state, in accordance with the present invention. The modular construction system 100 generally comprises: at least one balancing element 10, having a center of gravity, a vertical axis A-A (FIGS. 2 and 3), and at least one pair of parallel opposing surfaces, e.g., generally flat surfaces, such as at last one pair of primary balancing surfaces $S_1$, and at least one secondary balancing surface $S_2$, for enhancing equilibrium; and a plurality of permanent magnets 50, at least two permanent magnets 50 of the plurality of permanent magnets 50 being collinearly disposed along the vertical axis A-A (FIGS. 2 and 3) for facilitating balancing, and at least one permanent magnet 50 of the plurality of permanent magnets 50 being offset in relation to the vertical axis A-A for providing balanceable moments of inertia, whereby balancing the at least one balancing element 10 is facilitated. The present system 100 further comprises at least one base 20 optionally having a magnetic property, wherein balancing the at least one balancing element 10 in relation to the base 20 is facilitated. In addition, the system 100 may further comprise an instruction booklet 30 explaining use of the base 20 and the at least one balancing element 10.

Still referring to FIG. 1, the at least one balancing element 10 is formed by at least one technique, such as molding, injection molding, vacuum bagging, cold pressing, hot pressing, rapid prototyping, and sculpting, and comprises at least one representation, such as at least one figurine, at least one living organism representation, at least one auxiliary element, and at least one non-living object representation. The at least one figurine and the at least one living organism representation may each be depicted in either a symmetric pose or an asymmetric pose. By example only, a plurality of living organism representations is joinable by attraction between respective permanent magnets 50 having an opposing polarity; and the at least one non-living object representation, comprising a plurality of magnets 50 having the same polarity, facilitates coupling a plurality of living organism representations thereto.

The at least one balancing element 10 comprises major components that are rigid, balanced figurines 10*a*. By example only, an upper contact point of one figurine 10*a* and a lower contact point of another figurine 10*a*, an auxiliary balancing element, or a substrate, such as a base 20, comprise generally flat surfaces or balancing surfaces, are disposed parallel to the substrate, and are equipped with magnets 50, e.g., embedded magnets, that are flush with the generally flat surfaces or opposing balancing surfaces, e.g., lower and upper balancing surfaces or primary balancing surfaces $S_1$. Each figurine 10*a* may be formed, e.g., injection-molded, sculpted or otherwise, in a manner such that it is balanced, in of itself, i.e., "integrally balanced," and that the figurine's center of gravity is disposed above the lower balancing surface $S_L$. In addition, the upper balancing surface $S_U$ is disposed above the lower balancing surface $S_L$ as well as above the center of gravity CG. Similarly-balanced figurines 10*a* may then be stacked on one another and experience little or no lateral forces, toppling forces, or torque, since the entire construction remains balanced. The present invention balancing elements 10, having opposing balancing surfaces, enhance the balanceability of the system 100 overall. In essence, present system 100 is stackable and utilizes a combination of a predominantly mechanical component stabilizing feature in the uniquely disposed opposing balancing surfaces (enhancing balance/gravity) and reinforcement provided by magnetism of the magnets 50.

The figurines 10*a*, being the major balancing elements, comprise three basic types. The first-type figurine $T_1$ is formed in a manner such that, despite its asymmetry, it has a pair of primary balancing surfaces, i.e., an upper balancing surface $S_U$ disposed vertically above a lower balancing surface $S_L$, i.e., in parallel as discussed, supra; and the first-type figurine's center of gravity CG is disposed along an axis A-A, e.g., a vertical axis, between the upper and lower balancing surfaces $S_U$, $S_L$ (see also FIG. 2) in elevation. These balancing surfaces $S_U$, $S_L$ can be utilized in further stacking and are, thus, denoted as "primary balancing surfaces" $S_1$. In addition, the first-type figurine $T_1$ may comprise at least one other balancing surface or secondary balancing surface $S_2$ that is positioned at a distance away from the vertical axis A-A between the two primary balancing surfaces $S_U$, $S_L$ in elevation and outboard from the figurine's center of gravity CG. This embodiment of the first-type figurine $T_1$ is balanced, but no other figurine 10*a* can be balanced on the first-type figurine $T_1$. For this reason, the at least one other balancing surface is denoted as a "secondary balancing surface" $S_2$. Since the first-type figurine $T_1$ can be balanced on two primary balancing surfaces $S_U$, $S_L$ and on at least one secondary surface $S_2$, creating a variety of constructions using only a few figurines 10*a* is facilitated, in accordance with the present invention.

The second-type figurine $T_2$ is formed in a manner such that it comprises three balancing surfaces, i.e., a lower balancing surface $S_L$ being vertically disposed below the second-type figurine's center of gravity CG and two upper balancing surfaces $S_U$ are equidistantly disposed at a distance away from an axis A-A which passes vertically through the center of gravity CG and lies on a plane defined by the center points of the second-type figurine's three balancing surfaces.

The third-type figurine $T_3$ is formed in a manner such that it comprises two upper balancing surfaces $S_U$ and two lower balancing surfaces $S_L$. The upper two or pair of balancing surfaces $S_U$ will be situated equidistant from a vertical axis A-A passing through the center of gravity and lying on a plane defined by the center points of the third-type figurine's four balancing surfaces. The lower two or pair of balancing surface CG and lying on a plane defined by the center points of the third-type figurine's four balancing surfaces. These two planes may be on the same plane or perpendicular to each other.

The balancing elements 10 may also comprise some minor components, e.g., smaller elements, such as auxiliary objects 10*b*, for facilitating construction of the system 100. These auxiliary objects may also comprise fanciful representations, such as a "Wonderball," a "Wonderfrog," and a "Wonderbear," etc. These auxiliary objects 10*b* may comprise balls, other objects, or compact figurines formed, e.g., sculpted, with upper and lower balancing surfaces $S_U$, $S_L$ vertically aligned and with the polarity of the magnet pairs arranged either "North-North," "South-South," or "North-South." The auxiliary objects 10*b* may be color-coded or characterized, e.g., by indicia, such that their polarity combinations are quickly recognized by the user(s). The function of the "North-North" or "South-South" auxiliary objects reverses the polarity of any balancing point as required for any desired configuration for the system 100. The function of the "North-South" auxiliary objects is the facilitation of adding height, e.g., most often for leveling a configuration of the system 100. All the auxiliary objects 10*b* may function as counter-weights to balance a construction of the system 100; and they may provide an aesthetic aspect or an amusement function.

The auxiliary objects 10*b* may also comprise fanciful representations having a swivel feature, such as "Swivel Wonderballs," "Swivel Wonderfrogs," and "Swivel Wonderbears," etc. While these auxiliary objects 10*b* are comprise a configuration that is akin to that of the "Wonderballs," "Wonderfrogs," and "Wonderbears," etc., and have corresponding combinations of magnetic polarities, they further comprise an adaptive feature, wherein the upper and lower balancing surfaces $S_U$, $S_L$ are slightly out of parallel, e.g., up to 5 degrees. The function of this adaptive feature is facilitating amelioration of any tilt that has been developed in any given construction of the system 100 by inserting such auxiliary object 10*b*, having an adaptive feature, into a construction at a desired location and rotating the auxiliary object 10*b* in a manner that minimizes or eliminates the tilt of the system 100. These auxiliary objects 10*b* may further comprise at least one feature, such as color-coding and indicia (not shown) for facilitating quick recognition by the user(s).

With respect to the at least one base plate 20 and on a perfectly level substrate, e.g., a horizontal surface, the user(s) may commence constructing the system 100 from a single figurine 10*a* and then balance several figurines 10*a* thereon. Alternatively, the user(s) may commence constructing the system 100 from a plurality of figurines 10*a* and then balance numerous figurines 10*a* thereon to form large constructions. In an alternative embodiment, the base plate 20 may be magnetized or non-magnetized, but comprising at least one feature, such as an attached spirit level and a leveling device (not shown), for facilitating horizontal disposition of the base plate 20 on a non-horizontal or less than horizontal surface.

With regard to modularization and in order to fabricate a system 100 that facilitates complex and stable constructions, the at least one balancing element 10 has been modularized in the present invention. The heights of the major components or the figurines 10*a* have been standardized as multiples of the minor components or auxiliary objects 10*b*, e.g., multiples of one-inch heights. Thus, for example, a 3-inch high figurine 10*a*, with the addition of a 1-inch high "Wonderball" as the auxiliary object 10*b* will be level with a 4-inch high figurine 10*a*. The distance between the primary balancing surfaces $S_1$ or, more particularly, of the embedded magnets 50 of the figurines 10*a*, having more than one primary balancing surface $S_1$, has been standardized. For example, such distance may be 2 inches or 4 inches. The weights of similarly sized figurines 10*a* have been adjusted to be approximate or, if differently sized, be made approximate by adding at least one minor component. The polarity, e.g., "North-South," of the magnets 50 has been orientated to facilitate stacking and interconnection. Magnets 50 that are likely to connect will have opposite polarity. Magnets 50 may be in pairs, for example disposed at the two hands of a figurine 10*a*, one of which has a North polarity and the other of which has a South polarity. The secondary balancing surfaces $S_2$ are positioned whenever possible to facilitate cross-linkages, as opposed to stacking linkages, within the system 100.

Figure 2:
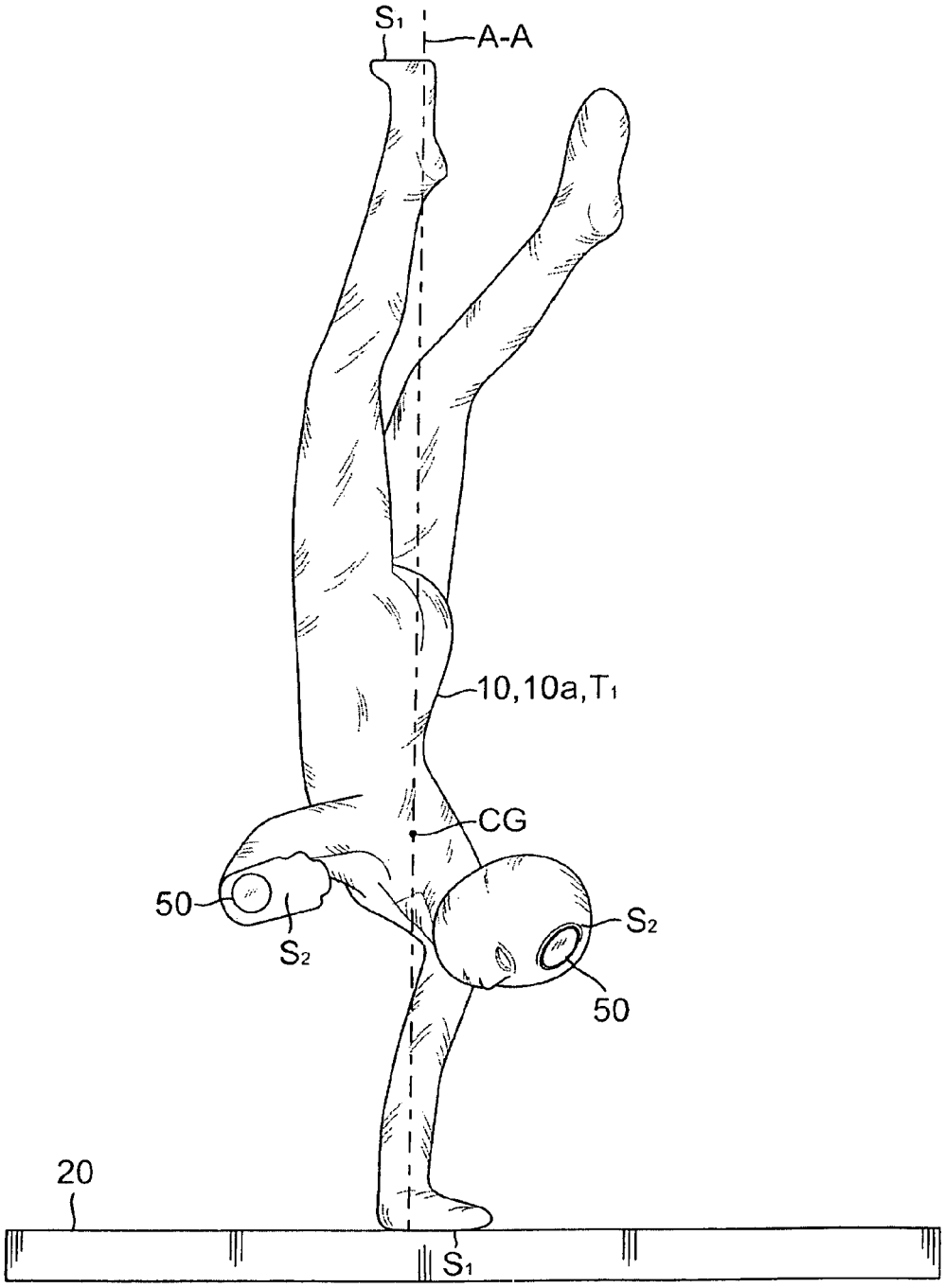
FIG. 2 is a side view of a balancing element comprising a modular asymmetrically-balanced male figurine with vertically-aligned magnets disposed at corresponding primary balancing surfaces and showing other magnets disposed at corresponding secondary balancing surfaces for facilitating balance, by example only, in accordance with the present invention.
Figure 3:
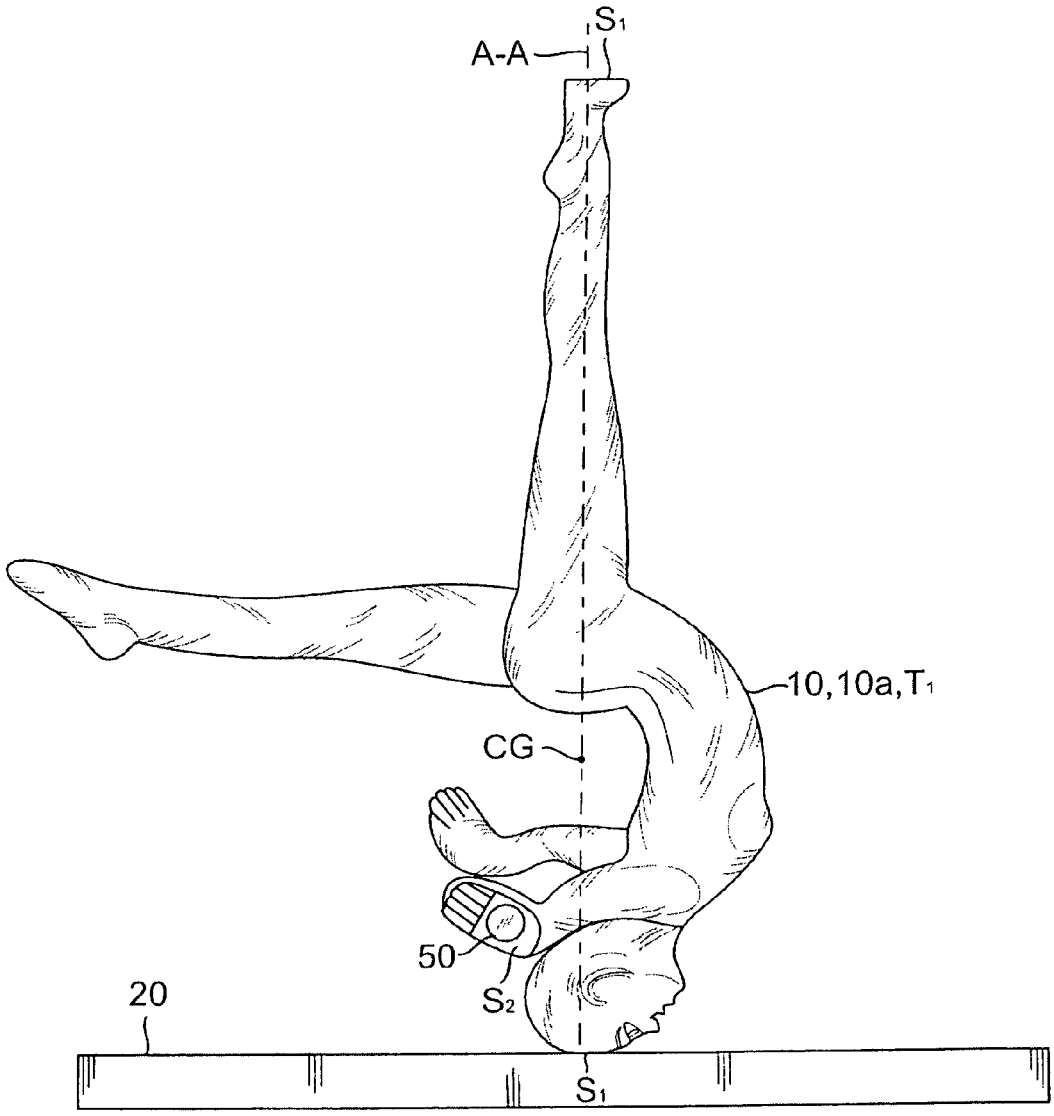
FIG. 3 is a side view of a balancing element comprising a modular asymmetrically-balanced female figurine with vertically-aligned magnets disposed at corresponding primary balancing surfaces and showing magnets disposed at corresponding secondary balancing surfaces having magnets for facilitating balance, by example only, in accordance with the present invention.

Referring to FIGS. 2 and 3, the at least one magnet 50 is embedded in the at least one balancing element 10 at a location conducive to coupling with any other at least one balancing element 10 or with the at least one base 20, i.e., in a disposition that is flush with a surface, such as a primary balancing surface $S_1$ or a secondary balancing surface $S_2$. The at least one base 20 comprises at least one element, such as at least one leveling device (not shown), at least one metallic plate, and at least one metallic board. The at least one balancing element 10 comprises a light-weight rigid polymer, such as a plastic, an ABS plastic, a resin, a polyurethane, a polypropylene, and a polyethylene, by example only. The plurality of magnets 50 comprises at least one magnetic element, such as a rare-earth type magnet and an axially-magnetized neodymium disc-magnet. The system 100 may further comprise at least one gyroscopic feature (not shown) for further challenging a user in balancing the at least one balancing element 10.

Referring to FIGS. 1-3, the at least one living organism representation comprises at least one representation, such as at least one multicellular organism representation, e.g., the respective male and female figurines 10*a* (FIGS. 2 and 3) and at least one unicellular organism representation, wherein the at least one multicellular organism representation comprises at least one representation, such as at least one human representation, and wherein the at least one human representation comprises at least one representation, such as a circus entertainer, a clown, a trapeze artist, a contortionist, an acrobat, a dancer, a ballet dancer, a jazz dancer, a flamenco dancer, a belly dancer, a folk dancer, a synchronized swimmer, a follies performer, a gypsy, a gypsy dancer, a cheerleader, an athlete, a sports figure, a celebrity, and a political figure, by example only. The at least one non-human animal representation comprises any non-human zoological specie representation, e.g., a monkey and a frog, by example only. The at least one fanciful character representation comprises at least one representation, e.g., a fantasy representation, such as a mermaid, a superhuman, a fairy, and a space alien, by example only. The at least one auxiliary object comprises at least one non-living object representation, such as a ball, a Wonder® ball, a swivel ball, a baton, a trapeze, a tightrope, a wand, a scepter, and a pedestal, by example only.

In present invention fabrication method $M_1$, the components have to be made with a high degree of accuracy, particularly with respect to their heights and the parallelism of their primary balancing surfaces in order for the system to perform well. The components are formed from lightweight, but very strong materials, since the challenge in constructing very high assemblies, would otherwise, result in rapid tumbling. As such, the balancing elements 10 may be numerous; and an affordable fabrication method is desirable. One preferred method of fabrication comprises injection molding a high strength plastic. However, since injection molding has severe limitations in the production of asymmetric free-form shapes due the molds being necessarily rigid and since the larger cross-sections of the components, e.g., the balancing elements, are likely to shrink and distort after de-molding (removal from the mold), the present method of fabrication comprises the step of separately injection-molding portions of the balancing elements, especially the figurines 10*a*. The magnets 50, e.g., the "primary" magnets are then installed at the primary balancing surfaces $S_1$. The figurines 10*a* may be formed as upper and lower sections that are then attached by their magnets 50 to a magnetizable metallic jig (not shown) that precisely positions the upper and lower sections, wherein the sections are then joinable by joining element, such as an adhesive.

The present invention fabrication method $M_1$, alternatively, comprises forming the figurines 10*a* by a sculpting technique. The figurine 10*a* is sculpted, absent the portion or extension on which the lower balancing surface $S_L$ is intended to be situated; and the lower balancing surface $S_L$ is sculpted separately. The figurine 10*a* is then suspended by a string or a wire attached to the point where the upper balancing surface $S_U$ is intended to be situated. The sculpted lower balancing surface $S_L$ is positioned vertically beneath and perpendicular to the point of suspension; and a connecting portion is sculpted for joining the sculpted lower balancing surface $S_L$ to the figurine 10*a*. The figurine 10*a* is then inverted; and the same process used to position the upper balancing surface $S_U$ which then functions as the lower balancing surface $S_L$. This process may have iterative in order to achieve the desired result.

In the present invention method $M_2$ of using the system 100, the balancing elements 10 may be assembled in endless combinations and permutations and with nearly endless height limitations, because many figurines 10*a*, as possible, can be balanced on even a single lower primary balancing surface $S_L$ in a given period of time, e.g., racing to build the assembly against time. By example only, the present invention system 100 may be used as a game, wherein the object of the competition, e.g., as individuals or as teams, is to assemble the balancing elements 10 as high as possible, i.e., $\Delta h\uparrow$, without disturbing the assembly and without causing disassembly thereof or to assemble the balancing elements 10 in as short a period of time, i.e., $\Delta t\downarrow$, as possible. Further, Wonder® balls may be used as an auxiliary object 10*b* for reversing magnetic polarity, for leveling constructions, or for providing further providing balancing challenge. Swivel balls may be used as an auxiliary object 10*b* for realigning constructions, wherein the magnetic surfaces are not parallel. The system 100 may also be used as an educational tool for teaching the interrelationships of biological, chemical, and physical components. The base plate 20 may further comprise at least one feature, such as a musical player (not shown) for entertaining the user(s) and a timer for use in a time-dependent game.

The present invention method $M_2$ of using the present invention system 100 may involve several exemplary manifestations. For example, the system 100 may be used as a game, wherein two individuals or two teams could compete, utilizing either two equal sets of system components or one set of components and a timing device (not shown), including, but not limited to, a music player (not shown) in the base 20, in assembling the tallest construction, in assembling the construction with the most components balanced on a given number of base ("ground" level) components or on a particular balancing surface of one component, e.g., one foot or one hand.

In addition, the system 100 may be used as an education tool, wherein the principles of balance and magnetism are taught; and manual dexterity is practiced as well via the exercise thereof. Further, the system 100 may be used as a form of occupational therapy for users who are challenged in manual dexterity or fine motor skills. The figurines 10*a* may comprise indicia (not shown), such as color-coding, numbers, and letters, e.g., the indicia that would be shown on sports team uniforms, thereby facilitating youngsters in learning to count or spell while playing with the system 100.

Also, the system 100 may be used thematically, e.g., as related to collective groups of people, animals, and other subjects, for example, but not limited to, families, tribes, societies, species, professions, trades, teams, groups, collections, schools, occupations, environments, ethnic groups, etc. By example only, present invention themes may include a circus of clowns and animals, a troupe of acrobats, a company of dancers, a team of football players and cheerleaders, a court of lawyers, jury, judges and plaintiffs, space aliens and spacemen, a chorus line, witches fairies, elves and ogres, doctors, nurses patients, species of primates, endangered species, African animals, Artic animals, etc. The system 100 may also comprise themes relating to a story, a motion picture, a television series, a song, a rhyme, a book, a play, an opera, a musical, etc. By example only, present invention themes may further include "The Twelve Days of Christmas," "Pirates of the Caribbean," "Sesame Street," and "Snow White and the Seven Dwarves."

Information, as herein shown and described in detail, is fully capable of attaining the above-described object of the invention. The presently preferred embodiment of the invention is, thus, representative of the subject matter, which is broadly contemplated by the present invention. The scope of the present invention also fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

As used in this description and in the claims which follow, the term "asymmetric" means that the relevant object, overall, does not have reflection, line or mirror symmetry, or any order of rotational symmetry.

Moreover, no requirement exists for a device or: method to address each and every problem that is sought to be resolved by the present invention, for such to be encompassed by the present claims. Furthermore, no element, component, or method step in the present disclosure is intended to be dedicated to the public, regardless of whether the element, component, or method step is explicitly recited in the claims. However, that various changes and modifications, in form, material, and fabrication material detail, may be made, without departing from the spirit and scope of the invention as set forth in the appended claims, should be readily apparent to those of ordinary skill in the art as being encompassed by the present invention. No claim herein is to be construed under the provisions of 35 U.S.C. §112, sixth paragraph, unless the element is expressly recited using the phrase "means for."

INDUSTRIAL APPLICABILITY

The present invention industrially applies to novelty item, game, toy, interactive art piece, amusement, and educational systems and methods. More particularly, the present invention industrially applies to novelty item, game, toy, interactive art piece, amusement, and educational systems and methods for use on a horizontal surface. Even more particularly, the present invention industrially applies to modular novelty item, game, toy, interactive art piece, amusement, and educational systems and methods for use on a horizontal surface.

What is claimed is:

1. A modular toy construction system which comprises a plurality of irregularly shaped and asymmetrically configured three-dimensional permanently formed toy articles each having a center of mass and each of which includes a pair of essentially planar standing surfaces which are essentially parallel to each other and which are spaced from each other along a line which passes essentially though each of the surfaces of the pair and to which each of the surfaces is perpendicular, the asymmetrical configuration of each of the articles existing with respect to the line between the standing surfaces of that article, the line between the surfaces passing in each of the articles sufficiently close to the center of mass of the article that a first one of the articles can be stood on a horizontal surface at one of the standing surfaces of the first article and a second one of the articles can be stood at one of its standing surfaces on the other standing surface of the first one of the articles.

2. A construction system according to claim 1 in which, in at least one of the articles, the line passes through both of the surfaces and essentially through the center of mass of the article.

3. A construction system according to claim 1 in which the articles of the plurality are figurines each of which has a pose different from the pose of each of the other figurines of the plurality.

4. A construction system according to claim 3 in which the distance in each article between its standing surfaces is an integral multiple of a selected unit distance.

5. A construction system according to claim 4 further comprising at least one object having opposite parallel standing surfaces spaced apart from each other a distance equal to the selected unit distance, and wherein the distance between the standing surfaces of at least one of the articles is N unit distances (N being an integer greater than 2), and the distance between the standing surfaces of at least one other article is N−1 unit distances.

6. A construction system according to claim 1 in which at least some of the articles of the plurality include at least one further standing surface displaced in the article from said line and so related to the center of gravity of the article that the article can stand on a horizontal surface at the further standing surface.

7. A construction system according to claim 1 in which there is present in association with each standing surface a permanent magnet of selected polarity, and including a base having a flat surface defined of a material capable of being attracted to a magnet of either polarity.

8. A construction system according to claim 7 in which the magnets associated with the pair of standing surfaces spaced along the line passing close to the center of mass of the article are magnets of opposite polarity.

9. A construction system according to claim 7 in which the magnets in each article are centered on the line which in that article passes close to the center of gravity of that article.

10. A construction system according to claim 7 in which the magnets in the articles are of uniform size.

11. A construction system according to claim 7 in which the combination of the effects of the magnets with the proximity of the center of mass of each article to the line passing through the standing surfaces of the article enables the article to be stood on the base when the base surface is essentially horizontal.

* * * * *